US005699770A

United States Patent [19]

Matsumoto et al.

[11] Patent Number: 5,699,770

[45] Date of Patent: Dec. 23, 1997

[54] FUEL INJECTION SYSTEM FOR ENGINE

[75] Inventors: Shuichi Matsumoto, Oobu; Masatoshi Kuroyanagi; Tetsuya Toyao, both of Kariya; Masashi Murakami, Oobu; Yukihisa Arakoma, Kariya, all of Japan

[73] Assignee: Denso Corporation, Kariya, Japan

[21] Appl. No.: 748,780

[22] Filed: Nov. 14, 1996

[30] Foreign Application Priority Data

Nov. 14, 1995 [JP] Japan ..... 7-295731

[51] Int. Cl.[6] ..... F07M 55/02; F01M 9/10

[52] U.S. Cl. ..... 123/470; 123/90.38

[58] Field of Search ..... 123/509, 90.38, 123/195 C, 470

[56] References Cited

U.S. PATENT DOCUMENTS

| | | | |
|---|---|---|---|
| 4,757,789 | 7/1988 | Laine | 123/90.38 |
| 4,993,636 | 2/1991 | Taue et al. . | |
| 5,003,958 | 4/1991 | Yoneyama et al. | 123/90.38 |
| 5,072,883 | 12/1991 | Taue et al. . | |
| 5,390,642 | 2/1995 | Thoma | 123/509 |
| 5,603,303 | 2/1997 | Okajima et al. | 123/509 |

FOREIGN PATENT DOCUMENTS

| | | |
|---|---|---|
| 333 097 | 9/1989 | European Pat. Off. . |
| 1-224457 | 9/1989 | Japan . |
| 1-232161 | 9/1989 | Japan . |
| 5-195906 | 8/1993 | Japan . |
| 6-147053 | 5/1994 | Japan . |
| 6-173810 | 6/1994 | Japan . |
| 7-103107 | 4/1995 | Japan . |
| 7-109963 | 4/1995 | Japan . |

*Primary Examiner*—Thomas N. Moulis

*Attorney, Agent, or Firm*—Cushman, Darby & Cushman IP Group of Pillsbury Madison & Sutro LLP

[57] ABSTRACT

An accumulator fuel injection system for a diesel engine is provided which is designed to facilitates easy maintenance of an injector and may be used in different types of engines. The accumulator fuel injection system includes generally an injector, a solenoid valve for controlling injection timing, a connector supplying the power to the solenoid valve, a fuel supply pipe connection, and a fuel supply passage. The injector is installed in the engine to have an injector head disposed outside an engine head cover. The solenoid valve is disposed within the injector head eccentrically with the longitudinal center line of the injector. The connector is mounted on the injector head. The fuel supply connection is arranged opposite the injection nozzle across camshafts of exhaust and intake valves of the engine. The fuel supply passage is formed in a side wall of the injector head of said injector.

8 Claims, 12 Drawing Sheets

FUEL INJECTION SYSTEM FOR ENGINE

BACKGROUND OF THE INVENTION

1. Technical Field

The present invention relates generally to an accumulator fuel injection system for diesel engines designed to supply fuel stored in an accumulator under pressure to a solenoid valve-controlled fuel injector.

2. Background of Related Art

It is known in the art that the sum of intake and exhaust valves provided in each cylinder of a diesel engine are increased from two to four in order to improve air induction and exhaust efficiencies. It is also known that uniform fuel spray from injection nozzles of injectors is achieved by mounting the injectors coaxially with combustion chambers, and uniform air-fuel mixture is provided by bringing the center of the swirl into agreement with the center of each combustion chamber.

Problems encountered by such a fuel injection system for a diesel engine using a conventional fuel injector 100 as shown in FIG. 12 will be discussed below.

The shown engine is a DOHC engine having four valves for each cylinder. The injector 100 is mounted coaxially with the combustion chamber 113. The injector 100 partially projects at an end opposite to a nozzle from the engine head cover 111 and is secured on the cylinder head 110 through a fixing member 112. The cams 121 and 124 are mounted on the camshafts 120 and 123 for moving the exhaust valve 122 and the intake valve 125, respectively. The injector 100 is disposed between the camshafts 120 and 123 and surrounded by the four intake and exhaust valves in each cylinder. The fuel supply pipe connection 101 is arranged away from the camshafts 120 and 123 to the combustion chamber 113. The fuel return pipe connection 102 and the solenoid connector 103 of the injector 100 are mounted on the injector head 100*a* outside the engine head cover 111.

The injector 100 is, however, difficult to mount in the cylinder head 110 because of interference of the fuel supply pipe connection 101 with the exhaust and intake valves 122 and 125, the camshafts 120 and 123, and cams 121 and 124. The mounting of the injector 100 thus requires removal of the camshafts 120 and 123 and rocker arms depending upon a drive system, resulting in an increase in number of operations for mounting and removing the injector 100.

Further, the shape of the injector 100, especially the shape and location of the fuel supply pipe connection 101 are greatly restricted by the camshafts 120 and 123 and/or the structure of the drive system for the exhaust and intake valves 122 and 125 such as rocker arms. This makes it difficult to design injectors common to different types of engines, thereby resulting in manufacture of few-of-a-kind injectors.

Japanese Patent First Publication No. 7-103107 teaches a conventional fuel supply system which is designed to alleviate the problems as discussed above. In this fuel supply system, fuel supply pipes are mounted parallel to the injector in an extension member extending perpendicular to the injector without interference of the fuel supply pipes with intake and exhaust valves and parts of a drive system of the intake valves.

The fuel supply system, however, requires the space for installing the extension member around the injector. This makes it difficult to arrange camshafts for the intake and exhaust valves close to each other, leading to the disadvantage that it is difficult to decrease the size of an engine head. The close proximity of the camshafts to the injector for decreasing the size of the engine will cause the extension member to interfere with the exhaust and intake valves and the drive system for the intake valves upon installation and removal of the injector as long as the extension member projects outward from the camshafts, thus resulting in complex maintenance of the injector.

A fuel supply port for supplying fuel to a fuel supply system including the extension member and the fuel supply pipes projects outside the head cover at a location different from an injector head, thereby requiring formation of a plurality of through holes in the head cover of each cylinder. This results in an increase in number of machining operations and difficulties in positioning the head cover when disposed on the injector.

SUMMARY OF THE INVENTION

It is therefore a principal object of the present invention to avoid the disadvantages of the prior art.

It is another object of the present invention to provide a fuel injection system for an engine designed to facilitate easy maintenance of injectors and capable of being used in different types of engines.

According to one aspect of the present invention, there is provided a fuel injection apparatus for an engine which comprises (a) an injector having a given length, including an injector head and an injection nozzle opposite to the injector head for injecting fuel stored in an accumulator chamber under pressure into a cylinder of the engine, the injector head of the injector being exposed outside an engine head cover through a hole; (b) a solenoid valve controlling injection timing of the injector, the solenoid valve being disposed within the injector head of the injector eccentrically with a longitudinal center line of the injector; (c) a connector supplying power to the solenoid valve, disposed on the injector head of the injector so as to be exposed outside the engine head cover; (d) a fuel supply pipe connection connecting a fuel supply pipe with the injector, the fuel supply pipe connection being disposed opposite the injection nozzle of the injector across at least one of camshafts of exhaust and intake valves; and (e) a fuel supply passage connected to the fuel supply pipe connection for supplying the fuel to the injection nozzle of the injector, the fuel supply passage being formed in a side wall of the injector head of the injector.

In the preferred mode of the invention, the injector has a fuel return pipe connection connected to a fuel return pipe for discharging excess fuel which is arranged opposite the injection nozzle across the camshafts of the engine.

The fuel supply pipe connection and the fuel return pipe connection are disposed between the camshafts and the engine head cover.

The accumulator chamber is disposed within the engine head cover.

The fuel supply pipe connection and the fuel return pipe connection are disposed outside the engine head cover.

The fuel supply pipe connection, the fuel return pipe connection, and the connector extend from the injector head of the injector so as to allow the fuel supply pipe, the fuel return pipe, and a power source connector to be connected to the fuel supply pipe connection, the fuel return pipe connection, and the connector, respectively, from a direction parallel to the longitudinal center line of the injector.

A sealing member is further provided which is disposed between the injector and the engine head cover for establishing air-tight seal therebetween.

The hole formed in the engine head cover has a circular shape. The injector head has a circular horizontal cross section in the hole.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings:

FIG. 2(*b*) is a top view as viewed from an arrow B in FIG. 2(*a*);

FIG. 2(*c*) is a partially enlarged view of FIG. 2(*a*).

FIG. 9(*b*) is a top view as viewed from an arrow B in FIG. 9(*a*);

FIG. 9(*c*) is a partially enlarged view of FIG. 9(*a*).

DESCRIPTION OF THE PREFERRED EMBODIMENT

Figure 1:
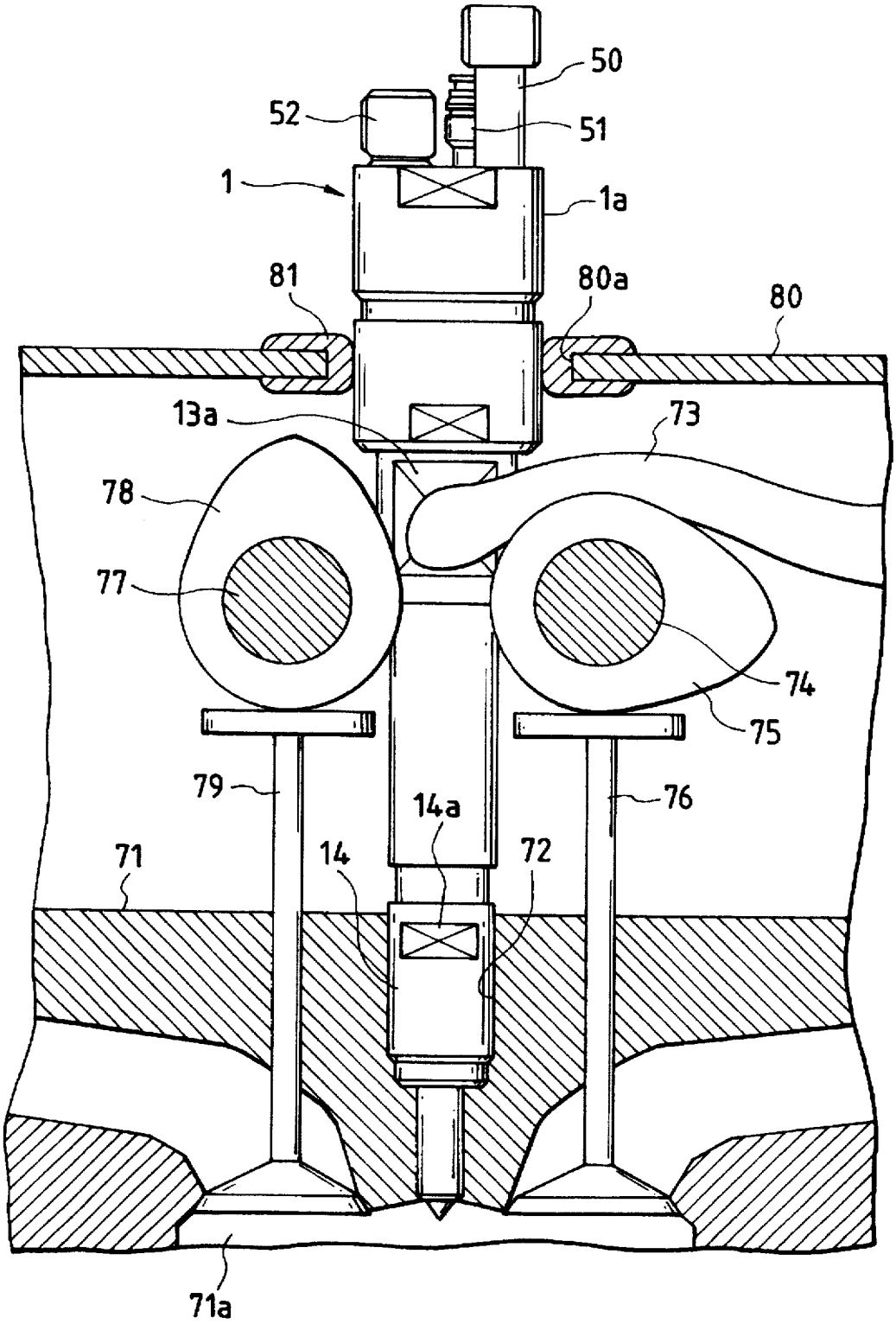
FIG. 1 is a partially cross sectional view which shows an accumulator fuel injection system for a diesel engine according to the present invention.

Referring now to the drawings, particularly to FIG. 1, there is shown an accumulator fuel injection system according to the invention.

The shown engine is a four-cylinder DOHC engine having disposed in each cylinder exhaust and intake valves whose number is four in total. The high-pressure fuel stored in an accumulator of a common rail (not shown) is supplied to the injector 1.

Figure 2A:
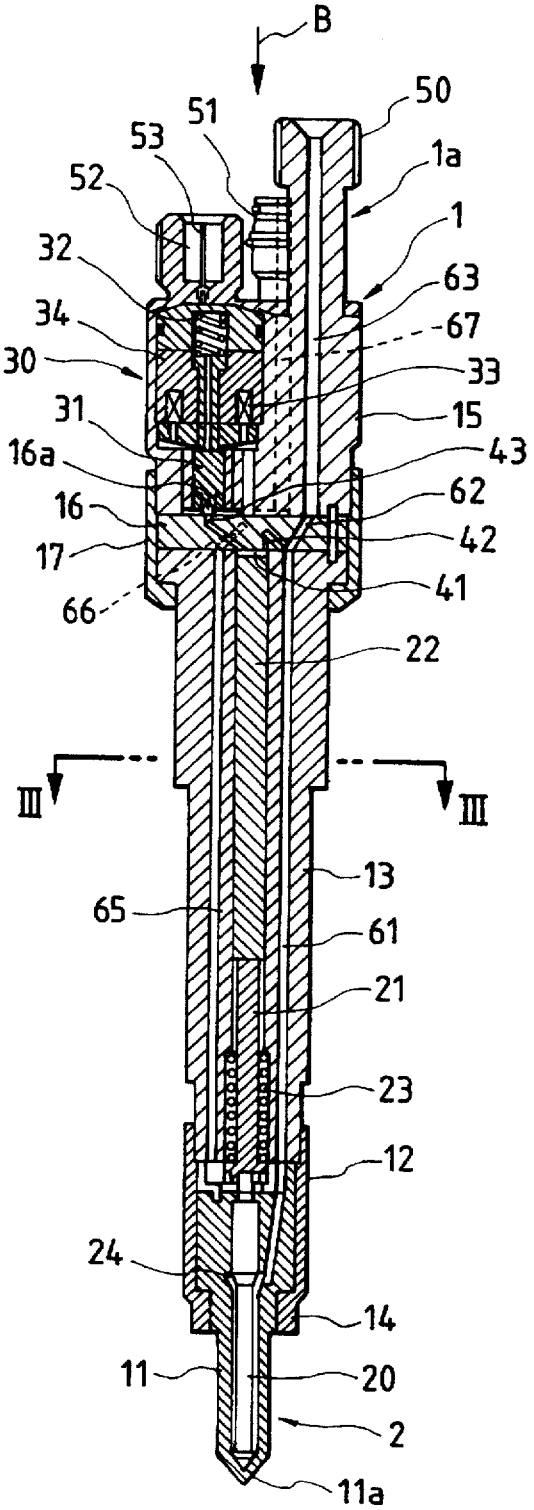
FIG. 2(*a*) is a vertical cross sectional view which shows a fuel injector.
Figure 2B:
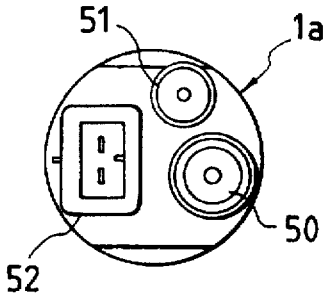
Figure 2C:
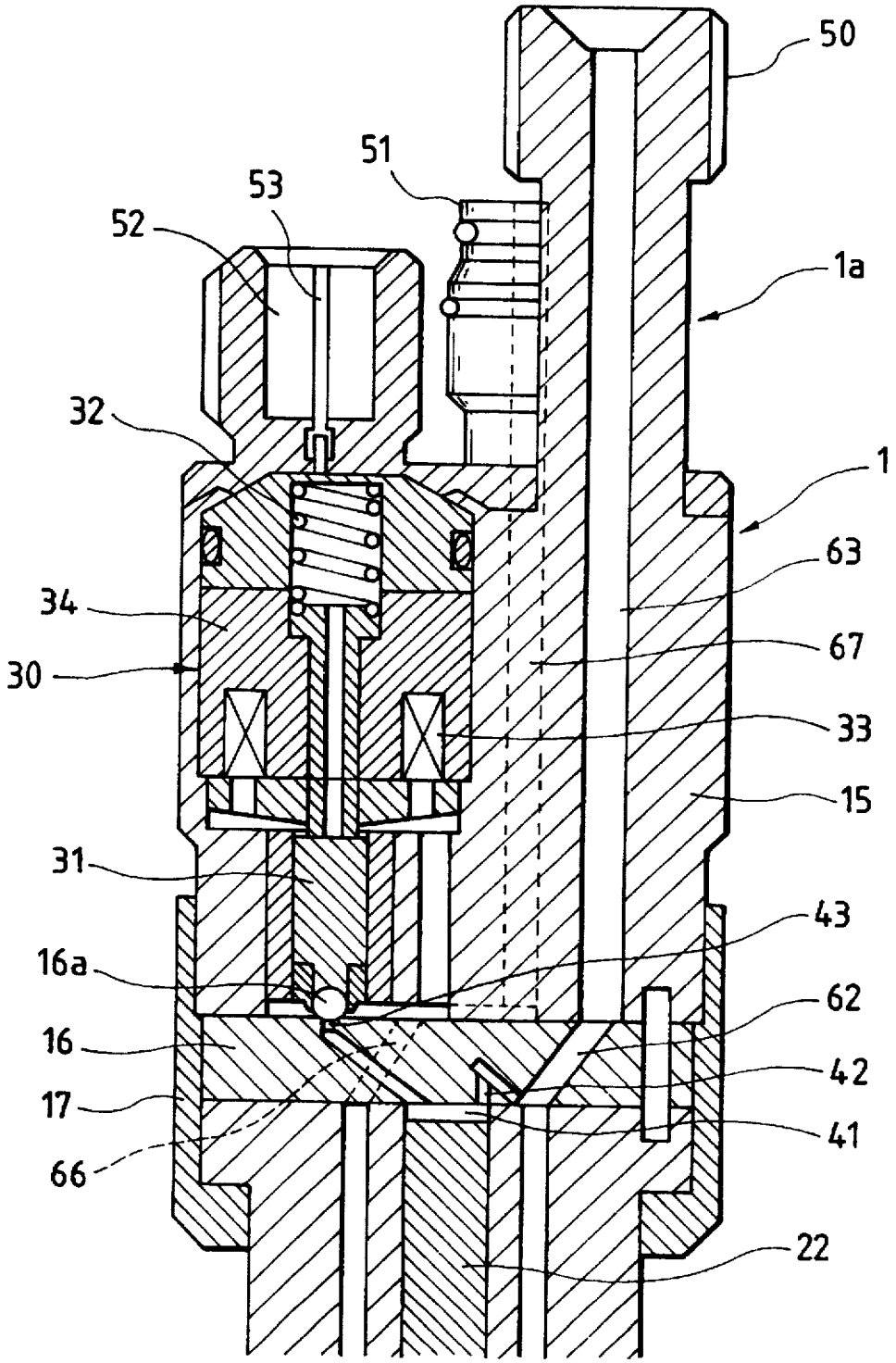

The injector 1 includes, as shown in FIG. 2(*a*), a needle 20 slidably disposed within a nozzle body 11 of an injection nozzle 2 for opening and closing a spray hole 11*a*. The nozzle body 11 and an injector body 13 are connected by a retaining nut 14 through a distance piece 12. A control piston 22 is disposed within the injector body 13 in alignment with a pressure pin 21 connected to the needle 20. The pressure pin 21 is inserted into a spring 23. The spring 23 urges the pressure pin 21 downward, as viewed in the drawing, to close the spray hole 11*a*. A pressure control chamber 41 is defined by an end of the control piston 22 opposed to the spray hole 11*a*. The control piston 22 is disposed slidably along the longitudinal center line of the nozzle body 13. A high-pressure fuel supply passage 61 and a low-pressure fuel passage 65 for discharging an excess of the fuel are formed around the control piston 22.

The high-pressure fuel passages 61, 62, and 63 form a fuel supply line. The fuel is supplied through a fuel supply pipe from the common rail to the high-pressure fuel passage 61 through the high-pressure supply passages 63 and 62 and flows into an annular fuel reservoir 24 surrounding the needle 20 to lift the needle 20 upward. The low-pressure fuel passage 65 discharges the excess fuel leaking out of sliding parts within the injector 1 from the low-pressure fuel passage 66 to the low-pressure fuel passage 67 and returns it to a fuel tank through a fuel return pipe (not shown).

The injector head 1*a* has a valve housing 15 which is connected to the nozzle body 13 through a distance piece 16 using a retaining nut 17. A solenoid valve 30 is disposed within the valve housing 15. The distance piece 16 has formed therein the high-pressure fuel passage 62 communicating with the high-pressure fuel passage 61 and the low-pressure fuel passage 66 communicating with the low-pressure fuel passage 65. The distance piece 16 has also formed therein orifices 42 and 43. The orifice 42 communicates the high-pressure fuel passage 62 with the pressure control chamber 41 for supplying the high-pressure fuel to the pressure control chamber 41. The orifice 43 discharges the high-pressure fuel within the pressure control chamber 41 to a low-pressure side (i.e., the fuel tank).

The valve housing 15 has formed therein the high-pressure fuel passage 63 and the low-pressure fuel passage 67. The high-pressure fuel passage 63 communicates with the high-pressure fuel passage 62 and is exposed to the outside at a fuel supply pipe connection 50. The low-pressure fuel passage 67 communicates with the low-pressure fuel passage 66 and is exposed to the outside at a fuel return pipe connection 51.

The solenoid valve 30 is a solenoid two-port valve which selectively establishes and blocks fluid communication between the pressure control chamber 41 and the low-pressure fuel passage 67 and which is disposed within the valve housing 15 eccentrically with the longitudinal center line of the needle 20. This offers, as can be seen in FIGS. 2(*a*) to 2(*c*), more efficient use of the space within the valve housing 15, thereby allowing the high-pressure fuel passage 63 and the low-pressure fuel passage 67 to be formed in a peripheral wall of the valve housing 15 with a minimum increase in diameter of the injector head 1*a* of the injector 1. This provides the following beneficial results. Usually, many engine component parts such as cams, camshafts, fixing members, and camshaft bearings are, as shown in FIG. 1, mounted on an engine body around an injector, occupying a large amount of space above the engine body. This requires that the injector head 1*a*, if the size thereof is relatively large, be disposed above the engine component parts. Thus, restriction of the size of the injector head 1*a* from being increased permits the injector head 1*a* to be arranged close to the engine body, thereby decreasing the projection of the injector 1 from the engine head cover 80.

The solenoid valve 30 includes a valve 31 and a coil 33. The valve 31 is moved to selectively establish and block fluid communication between the orifice 43 and the low-pressure fuel passage 67 and urged by a spring 32 to a valve closing position. The coil 33 is disposed within a core 34 and supplied with the power from a pin 53 mounted in a connector 52.

In operation, when the coil 33 is turned off, the valve 31 is urged by the spring force of the spring 32 into constant engagement with a valve seat 16*a* formed on the distance piece 16 to block the communication between the orifice 43 and the low-pressure fuel passage 67 so that the fuel stored in the pressure control chamber 41 is held at high level. The force produced by the sum of the pressure of the fuel in the pressure control chamber 41 and the spring force of the spring 23, acting on the needle 20 downward, as viewed in FIG. 2(*a*), to close the spray hole 11*a*, is greater than the pressure of the fuel exerted on an annular surface of the needle 20 within the fuel reservoir 24 to open the spray hole 11*a*, thus causing the needle 20 to close the spray hole 11*a* for stopping the fuel from being sprayed.

When the coil 33 is turned on, it will cause the core 34 to produce a magnetic force attracting the valve 31 out of engagement with the valve seat 16*a* against the spring force of the spring 32 to establish the fluid communication between the orifice 43 and the low-pressure fuel passage 67, thereby causing the high-pressure fuel in the pressure control chamber 41 to flow into the low-pressure fuel passage 67 through the orifice 43. A fluid flow area (i.e., an opening) of the orifice 42 is smaller than that of the orifice 43 so that the pressure of the fuel in the pressure control chamber 41 is decreased. When the pressure of the fuel exerted on the annular surface of the needle 20 within the fuel reservoir 24 to open the spray hole 11*a* exceeds the force produced by the sum of the pressure of the fuel in the pressure control chamber 41 and the spring force of the spring 23, acting on the needle 20 to close the spray hole 11*a*, it will cause the needle 20 to be lifted upward to open the spray hole 11*a* to inject the fuel into the engine.

The fuel supply pipe connection 50, the fuel return pipe connection 51, and the connector 52 are formed on the injector head 11*a* and extend parallel to the center line of the injector 1 in a direction opposite the spray hole 11*a*.

Referring back to FIG. 1, the injector 1 is installed in the mounting hole 72 formed in the cylinder head 71 coaxially with the combustion chamber 71*a* and has the injector head 1*a* project outside the engine head cover 80 from the through hole 80*a* formed in the engine head cover 80. The fuel supply pipe connection 50, the fuel return pipe connection 51, and the connector 52 on the injector head 1*a* are also exposed outside the engine head cover 80. An annular sealing member 81 made of a heat and oil resistant elastic material is installed on an inner edge of the through hole 80*a* formed in the engine head cover 80 for establishing air-tight seal between the injector 1 and the engine cover head 80. The injector 1 has a circular shape in a horizontal cross section extending through the through hole 80*a* and the sealing member 81 in a coaxial relation to the through hole 80*a* and the sealing member 81 for allowing the engine head cover 80 to be disposed easily by passing the injector 1 through the through hole 80*a* even if the injector is mounted incorrectly so that it is shifted in a radial direction and for maintaining proper air-tight seal between the injector 1 and the engine head cover 80.

The camshafts 74 and 77 are rotated in synchronism with rotation of a not shown crankshaft (a complete rotation every two rotations of the crankshaft) and have disposed thereon the cams 75 and 78, respectively. The rotation of the camshafts 74 and 77 causes the exhaust and intake valves 76 and 79 to be moved reciprocally to introduce and discharge air into and from the combustion chamber 71*a*.

Figure 3:
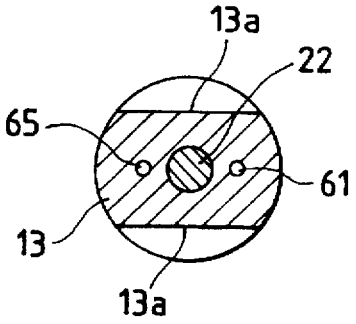
FIG. 3 is a horizontal cross sectional view taken along the line III—III in FIG. 2(*a*)

The injector 1 is installed in each cylinder between the camshafts 74 and 77 and surrounded by the four exhaust and intake valves 76 and 79. The injector 1 engages at its end the mounting hole 72 formed in the cylinder head 71 and is pressed against the cylinder head 71 by a forked fixing member 73. The injector 1 has, as shown in FIG. 3, width cross flats 13*a* diametrically opposed to each other for retaining the fixing member 73.

In mounting of the injector 1, the intake valves 79 and the camshafts 74 and 77 are installed in the engine prior to mounting the injector 1. The injector 1 is first inserted into the mounting hole 72 and then secured at its end in the cylinder head 71 under the pressure exerted by the fixing member 73 so that the injector 1 is oriented coaxially with the combustion chamber 71*a*.

Next, the engine head cover 80 having disposed thereon the sealing member 81 is disposed on the cylinder head 71 so that the injector 1 of each cylinder is arranged in engagement with the sealing member 81.

Finally, the fuel supply pipe is connected to the fuel supply pipe connection 50, while the fuel return pipe is connected to the fuel return pipe connection 51. A power source connector is electrically connected to the connector 52. This completes the mounting of the injector 1 in the engine.

The fuel supply pipe, the fuel return pipe, and the power source connector are, as clearly shown in the drawing, all installed in the engine from the same direction parallel to the axis of the injector 1, thereby facilitating easy connection thereof using, for example, an assembling robot. This results in a decrease in operation.

In the first embodiment, the eccentric arrangement of the solenoid valve 30 with the center line of the needle 20 allows the high-pressure fuel passage 63 and the low-pressure fuel passage 67 to be mounted in the injector head 1*a* disposed opposite the spray hole 11*a* and also allows the fuel supply pipe connection 50, the fuel return pipe connection 51 and the connector 52 to be disposed on the injector head 1*a* so that they extend parallel to the center line of the injector 1. The exposure of the fuel supply pipe connection 50, the fuel return pipe connection 51, and the connector 52 to the outside of the engine head cover 80 allows the exhaust and intake valves 76 and 79, component parts of the drive system of the exhaust and intake valves 76 and 79, the fuel return pipe, and the power source connector to be arranged without interfering with each other, thereby allowing the engine head cover 80 to be arranged close to the cylinder head 71. This also allows the drive system of the exhaust and intake valves 76 and 79 to be arranged close to the injector 1, resulting in a compact size of the engine. The drive system of the exhaust and intake valves 76 and 79, as discussed above, do not interfere with the injector 1, thereby allowing the size of the injector 1 to be determined regardless of the type of engine.

Additionally, the exposure of the fuel supply pipe connection 50, the fuel return pipe connection 51, and the connector 52 to the outside of the engine head cover 80 facilitates easy installation and removal of the injector 1 without removing component parts of the drive system such as the camshafts because the exhaust and intake valves 76 and 79 do not interfere with the injector 1. This results in a decrease in operation for maintenance.

Each cylinder, unlike the prior art structure taught in Japanese Patent First Publication No. 7-103107, requires the one through hole 80*a* for installation of the injector 1, thereby decreasing machining operations of the engine head cover 80. The decrease in number of the through holes 80*a* facilitates easy positioning of the engine head cover 80 when put on the injectors 1 during assembling.

Figure 4:
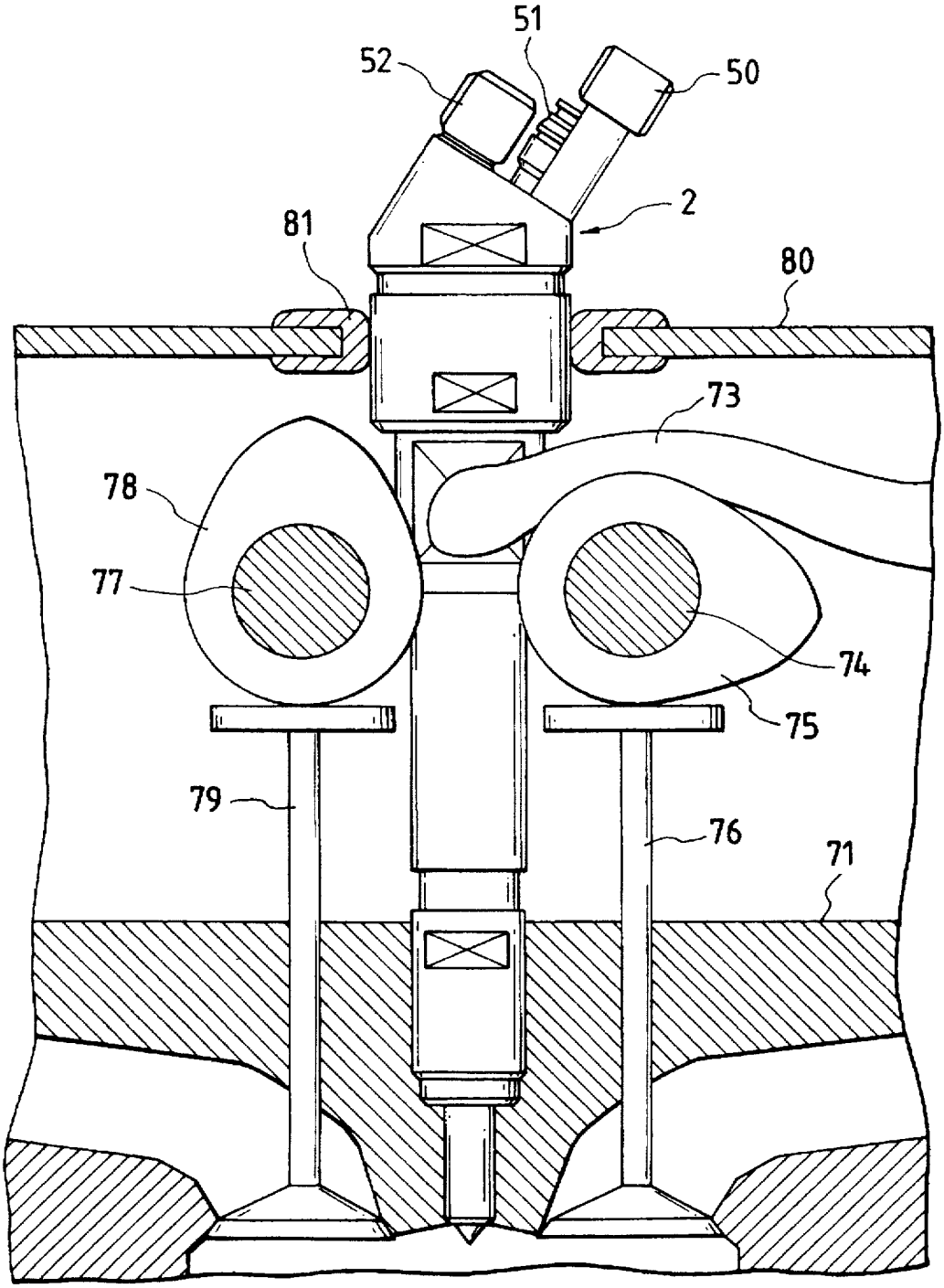
FIG. 4 is a partially cross sectional view which shows an accumulator fuel injection system according to the second embodiment of the invention.

FIG. 4 shows the second embodiment of the accumulator fuel injection system of the invention. The same reference numbers as employed in the above first embodiment refer to the same parts, and explanation thereof in detail will be omitted here.

The longitudinal center lines of the fuel supply pipe connection 50, the fuel return pipe connection 51, and the connector 52 are, as clearly shown in the drawing, oriented at a given angle to the longitudinal center line of the injector 2, thereby decreasing the overall height of a structure including the fuel supply pipe connection 50, the fuel return pipe connection 51, the connector 52, and pipes connected thereto. This results in a decrease in space required outside the engine head cover 80.

Upon mounting of the injectors 2 in the cylinders of the engine, the fuel supply pipe connections 50, the fuel return pipe connections 51, and the connectors 52 may be oriented in the same direction in all the cylinders, thereby allowing the engine head cover 80 to be disposed on the cylinder head 71 easily along the inclination of the fuel supply pipe connections 50, the fuel return pipe connections 51, and the connectors 52.

Figure 5:
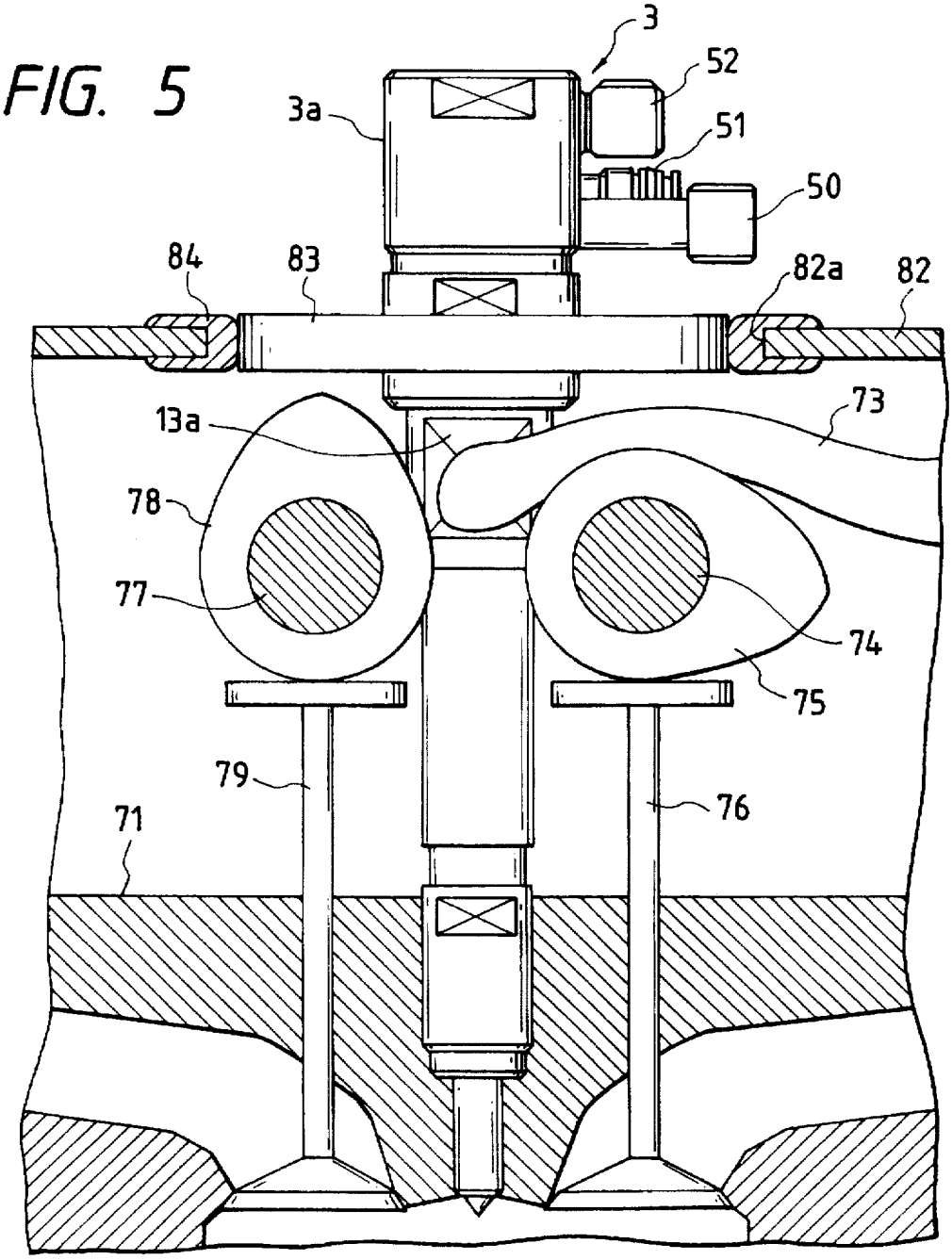
FIG. 5 is a partially cross sectional view which shows an accumulator fuel injection system according to the third embodiment of the invention.
Figure 6:
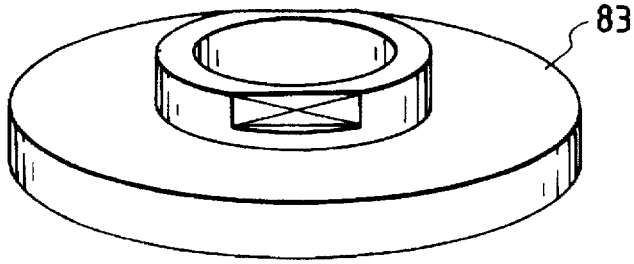
FIG. 6 is a perspective view which shows a retaining nut for retaining an injector.

FIGS. 5 and 6 show the third embodiment of the accumulator fuel injection system of the invention. The same reference numbers as employed in the first embodiment refer to the same parts, and explanation thereof in detail will be omitted here.

The longitudinal center line of the fuel supply pipe connection 50, the fuel return pipe connection 51, and the connector 52 are, as clearly shown in the drawing, oriented perpendicular to the longitudinal center line of the injector 3. The through hole 82*a* formed in the engine head cover 82 has an increased diameter required for the engine head cover 82 to be removed easily through the injector 3 after installed in the cylinder head 71. The retaining nut 83, as shown in FIG. 6, is disposed within the through hole 82 in air-tight engagement with the sealing member 84 for retaining the injector 3.

Figure 7:
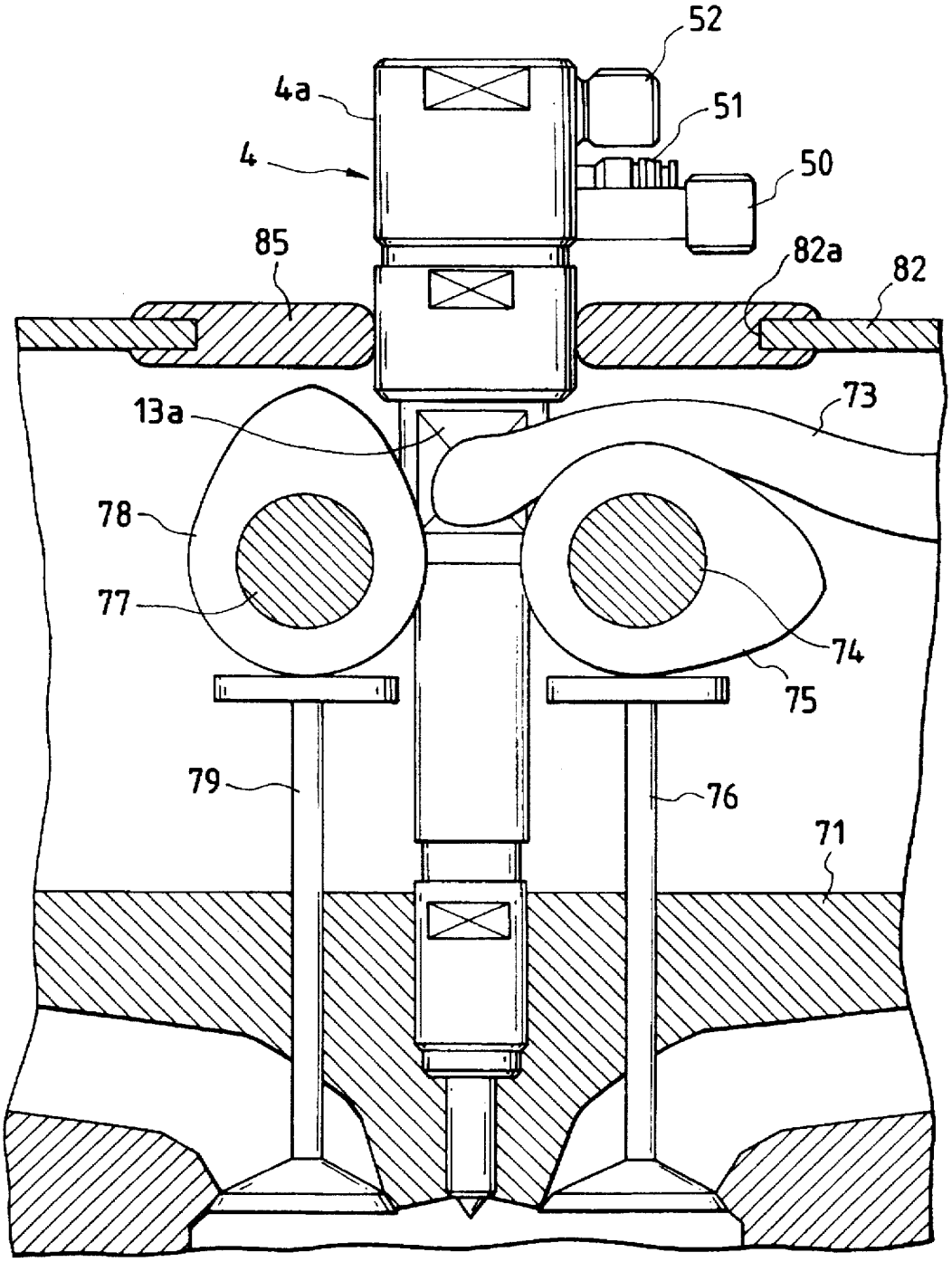
FIG. 7 is a partially cross sectional view which shows an accumulator fuel injection system according to the fourth embodiment of the invention.

FIG. 7 shows the fourth embodiment of the accumulator fuel injection system of the invention. The same reference numbers as employed in the first embodiment refer to the same parts, and explanation thereof in detail will be omitted here.

This embodiment is different from the third embodiment shown in FIG. 5 only in that a large-sized sealing member 85 is used in stead of the retaining nut 83. The sealing member 85 is made of an elastic material, and elastic deformation of the sealing member 85 facilitates easy installation of the engine cover 82 on the cylinder head 71 after the injector 4 is installed.

Figure 8:
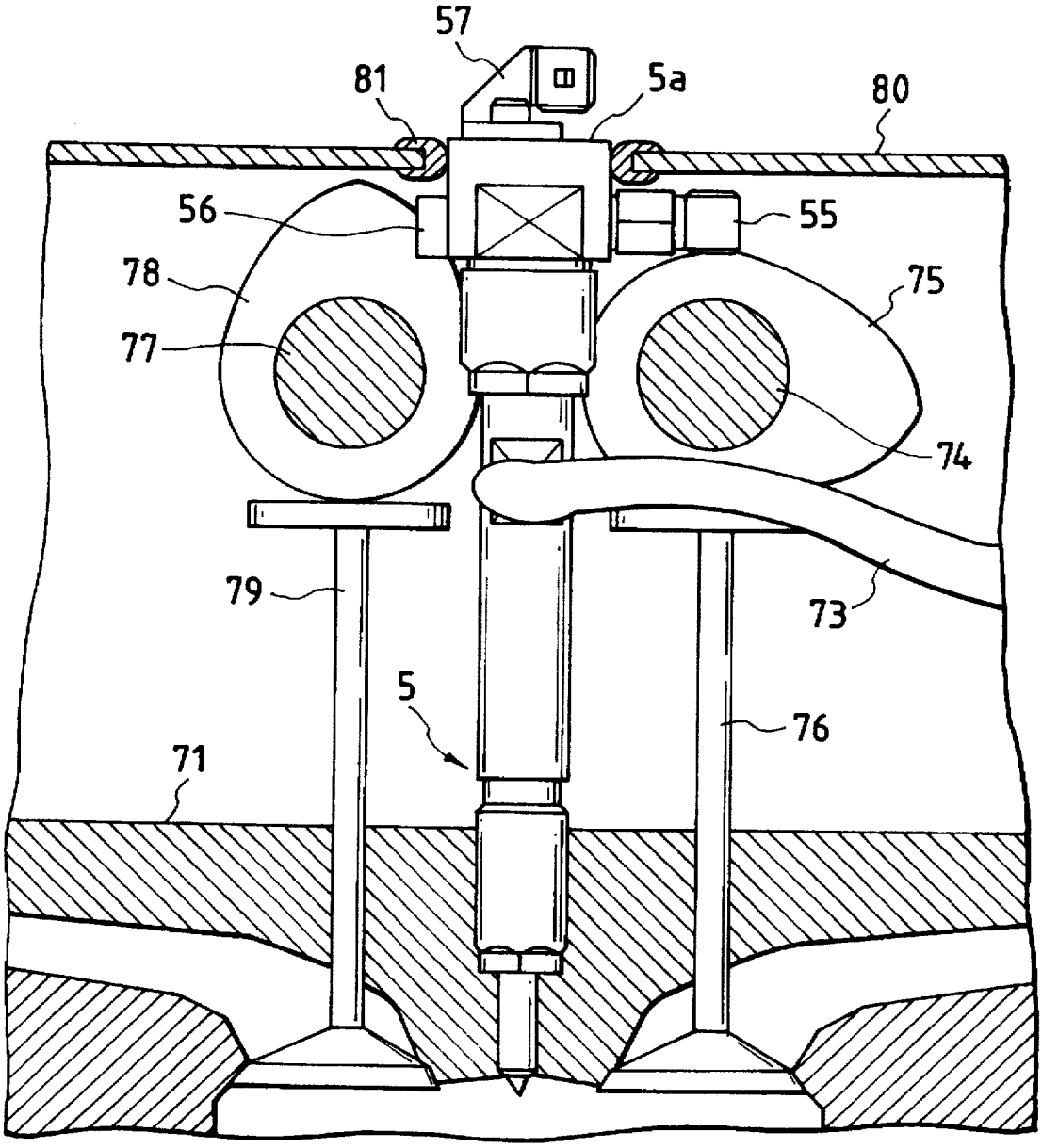
FIG. 8 is a partially cross sectional view which shows an accumulator fuel injection system according to the fifth embodiment of the invention.
Figure 9A:
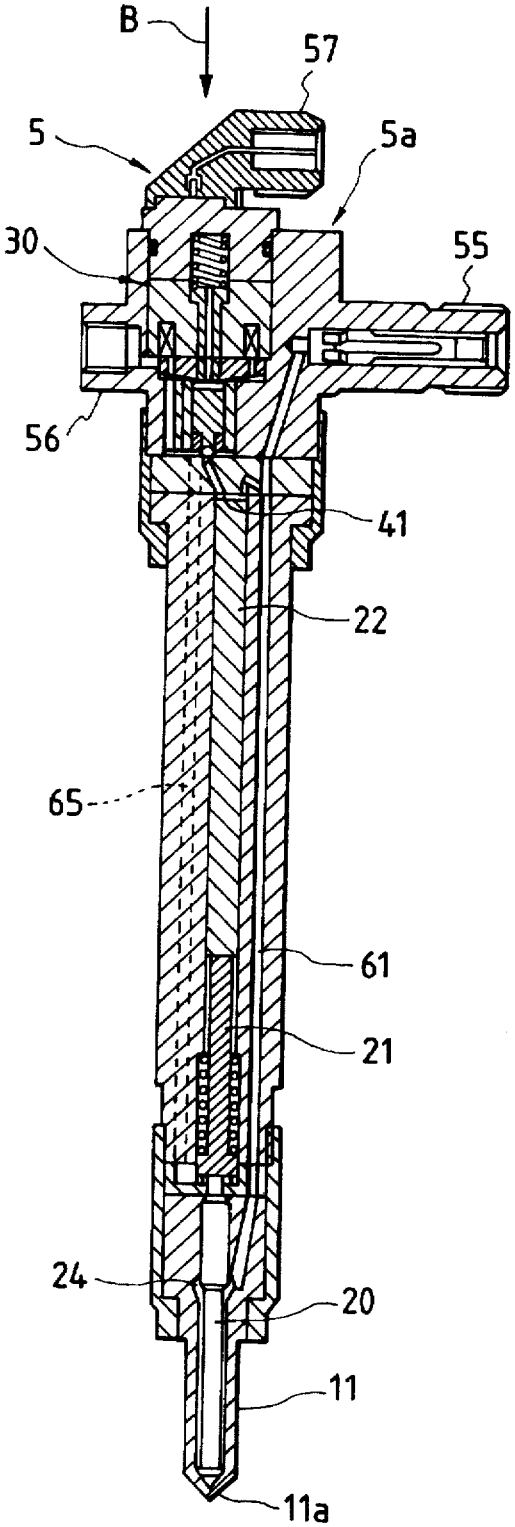
FIG. 9(*a*) is a vertical cross sectional view which shows the fuel injector in FIG. 8.
Figure 9B:
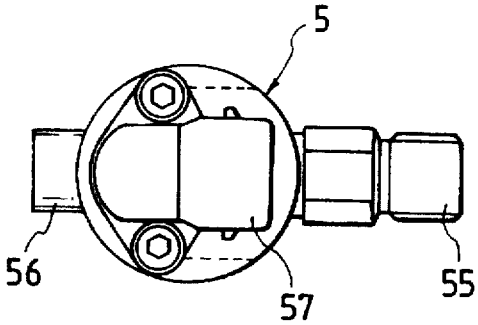
Figure 9C:
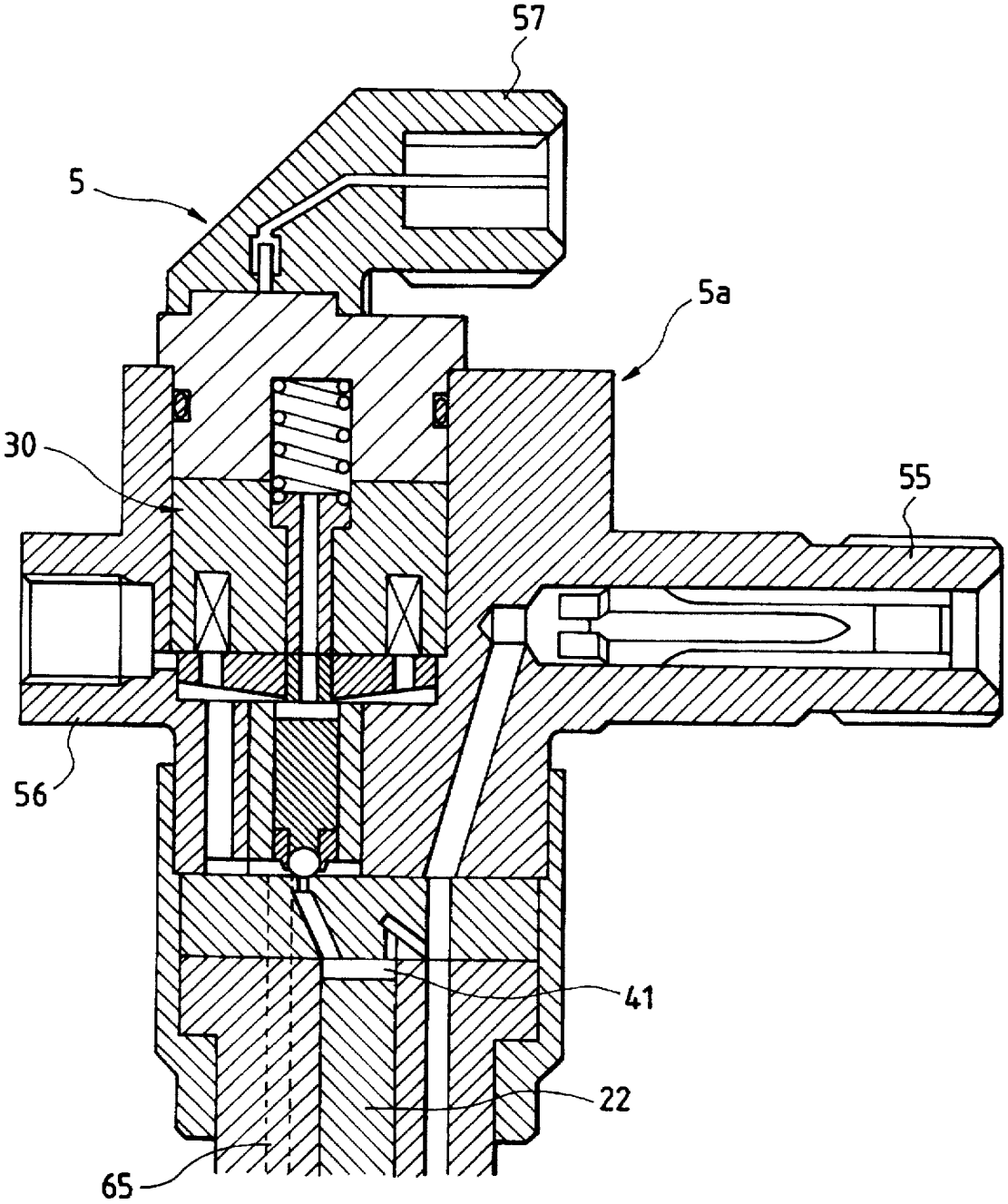

FIGS. 8, 9(*a*), and 9(*b*) show the fifth embodiment of the accumulator fuel injection system of the invention. The same reference numbers as employed in the first embodiment refer to the same parts, and explanation thereof in detail will be omitted here.

The fuel supply pipe connection 5 and the fuel return pipe connection 56 are, as shown in FIGS. 9(*a*) to 9(*c*), so oriented as to have the longitudinal center lines perpendicular to the longitudinal center line of the injector 5 and diametrically opposed to each other with respect to the longitudinal center line of the injector 5. The solenoid valve 30 is disposed within the injector head 5*a* at a location away from the longitudinal center line of the needle 20 in the radial direction.

The fuel supply pipe connection 55 and the fuel return pipe connection 56 are, as shown in FIG. 8, surrounded by the engine head cover 80 and the camshafts 74 and 77 and extends perpendicular the camshafts 74 and 77. The connector 57 of the solenoid valve 30 is disposed outside the engine head cover 80.

The arrangement of the fuel supply pipe connection 55 and the fuel return pipe connection 56 between the engine head cover 80 and the camshafts 74 and 77 allows the fuel supply pipe and the fuel return pipe to be connected to the injector 5 without interfering with the exhaust and intake valves 76 and 79 and the drive system of the exhaust and intake valves 76 and 79. The shape of the injector 5 is hardly restricted by the structure of the exhaust and intake valves 76 and 79 and the drive system of the exhaust and intake valves 76 and 79. This allows the injector 5 to be used in different types of engines.

The arrangement of the fuel supply pipe connection 55 and the fuel return pipe connection 56 between the engine head cover 80 and the camshafts 74 and 77 increases the space between the camshafts 74 and 77 and the engine head cover 80, resulting in an increase in overall size of the engine as compared with the above embodiments, but simplifies the shape of a portion of the injector 5 projecting outside of the engine head cover 80 because only the connector 57 is exposed to the outside.

Figure 10:
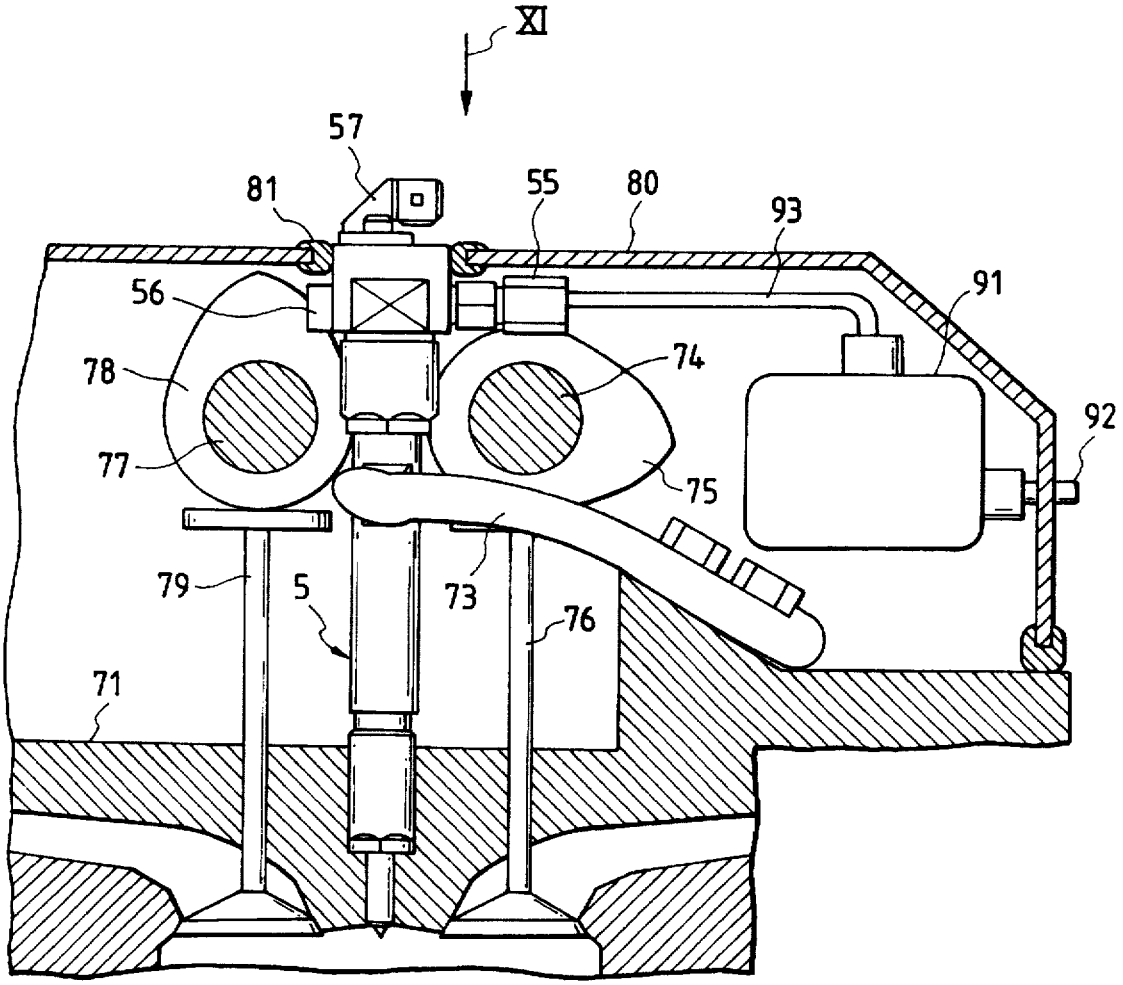
FIG. 10 is a partially cross sectional view which shows an accumulator fuel injection system according to the sixth embodiment of the invention.
Figure 11:
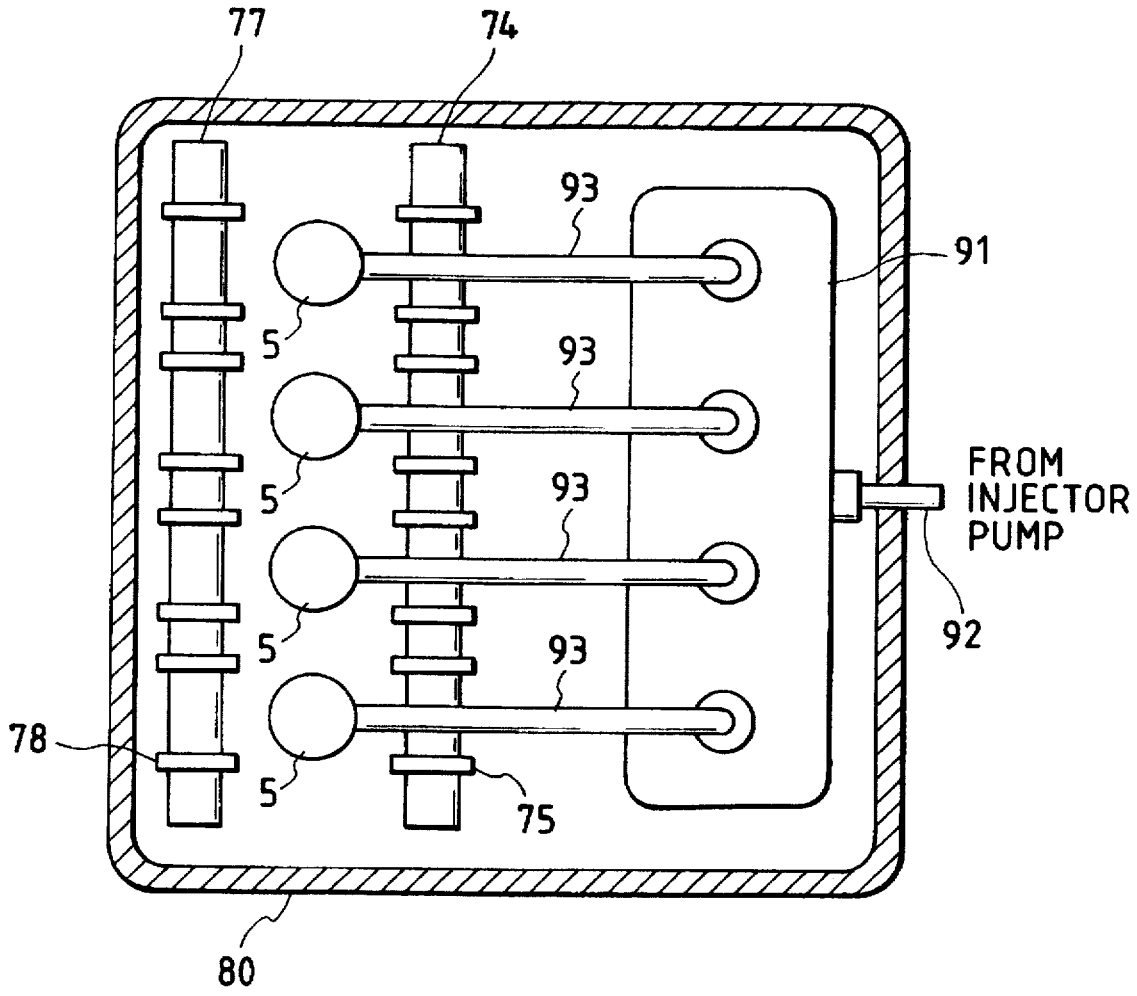
FIG. 11 is a top view as viewed from an arrow XI in FIG. 10 when an engine head cover is removed.
Figure 12:
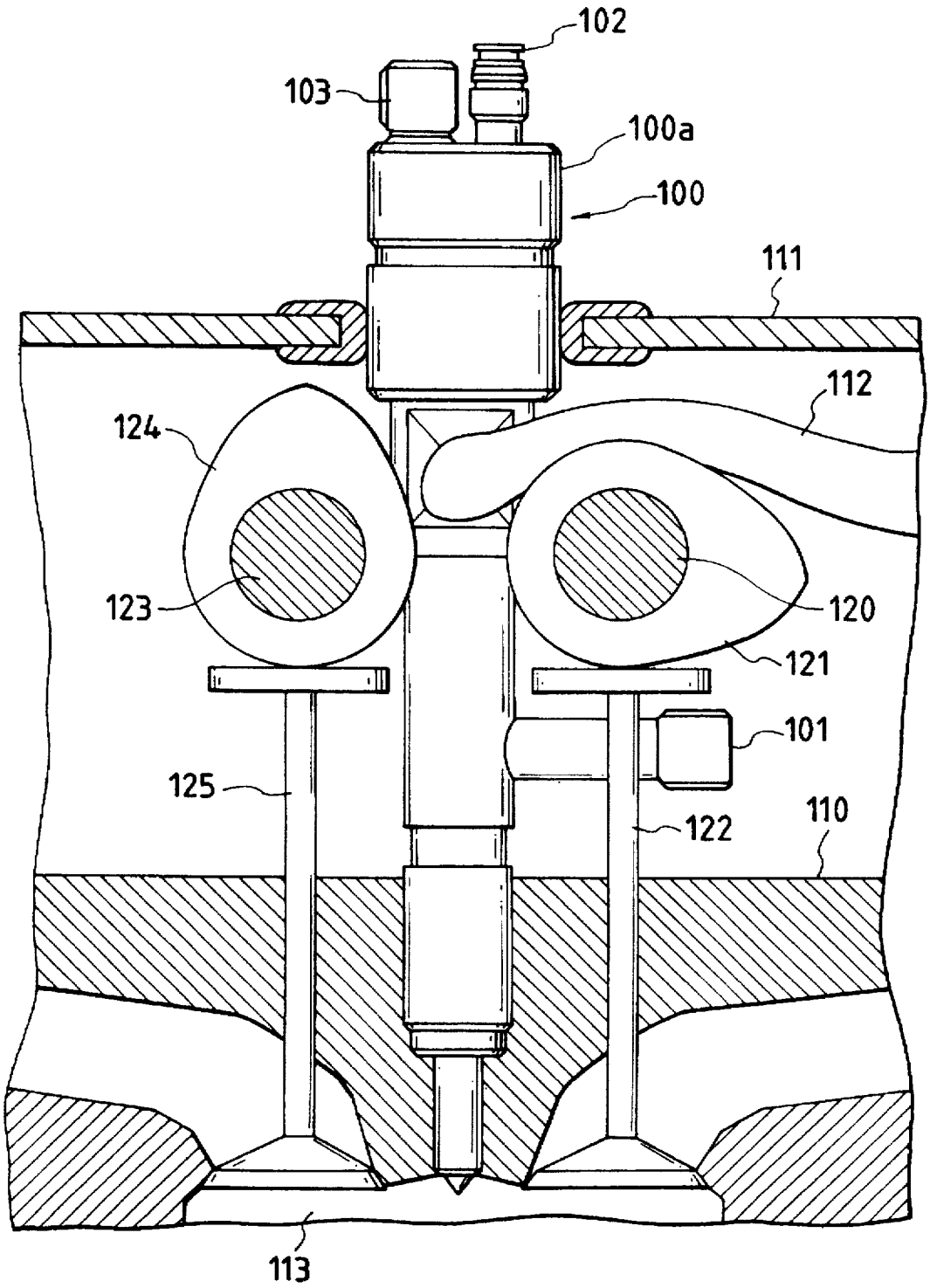
FIG. 12 PRIOR ART
FIG. 12 is a partially cross sectional view which shows a conventional accumulator fuel injection system.

FIGS. 10 and 11 show the sixth embodiment of the accumulator fuel injection system of the invention. The same reference numbers as employed in the first embodiment refer to the same parts, and explanation thereof in detail will be omitted here.

In this embodiment, the same injector 5 as in the fifth embodiment is used. The common rail 91 having formed therein an accumulator chamber is disposed within the engine head cover 80. The supply of high-pressure fuel to the injector 5 is achieved by forming only one through hole in the engine head cover 80 through which the fuel supply pie 92 passes to supply fuel from a fuel injection pump (not shown) to the common rail 91. The length of a connection between the injector 5 and the common rail 91 is decreased, thereby facilitating easy installation of the fuel supply pipe 93 which supplies the fuel from the common rail 91 to the injector 5.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims. For example, the injectors as discussed in the above embodiments are designed to discharge excess fuel, but returnless injectors may alternatively be used. The invention may be used with an engine having two exhaust and intake valves in each cylinder. The number of cylinders of the engine is not limited to four.

What is claimed is:

1. A fuel injection apparatus for an engine comprising:

an injector having a given length, including an injector head and an injection nozzle opposite to the injector head for injecting fuel stored in an accumulator chamber under pressure into a cylinder of the engine, the injector head of said injector being exposed outside an engine head cover through a hole;

a solenoid valve controlling injection timing of said injector, said solenoid valve being disposed within the injector head of said injector eccentrically with a longitudinal center line of said injector;

a connector supplying power to said solenoid valve, disposed on the injector head of said injector so as to be exposed outside the engine head cover;

a fuel supply pipe connection connecting a fuel supply pipe with said injector, said fuel supply pipe connection being disposed opposite the injection nozzle of said injector across at least one of camshafts of exhaust and intake valves; and a fuel supply passage connected to said fuel supply pipe connection for supplying the fuel to the injection nozzle of said injector, said fuel supply passage being formed in a side wall of the injector head of said injector.

2. A fuel injection apparatus as set forth in claim 1, wherein said injector has a fuel return pipe connection connected to a fuel return pipe for discharging excess fuel which is arranged opposite the injection nozzle across the camshafts of the engine.

3. A fuel injection apparatus as set forth in claim 2, wherein said fuel supply pipe connection and said fuel return pipe connection are disposed between the camshafts and the engine head cover.

4. A fuel injection apparatus as set forth in claim 3, wherein the accumulator chamber is disposed within the engine head cover.

5. A fuel injection apparatus as set forth in claim 2, wherein the fuel supply pipe connection and the fuel return pipe connection are disposed outside the engine head cover.

6. A fuel injection apparatus as set forth in claim 5, wherein said fuel supply pipe connection, said fuel return pipe connection, and said connector extend from the injector head of said injector so as to allow the fuel supply pipe, the fuel return pipe, and a power source connector to be connected to said fuel supply pipe connection, said fuel return pipe connection, and said connector, respectively, from a direction parallel to the longitudinal center line of said injector.

7. A fuel injection apparatus as set forth in claim 1, further comprising a sealing member disposed between said injector and the engine head cover for establishing air-tight seal therebetween.

8. A fuel injection apparatus as set forth in claim 1, wherein the hole formed in the engine head cover has a circular shape, and wherein said injector head has a circular horizontal cross section in the hole.

* * * * *